United States Patent [19]

Nishijima

[11] Patent Number: 4,954,432

[45] Date of Patent: Sep. 4, 1990

[54] PHOTOGRAPHIC MATERIAL WITH SOLVENT HAVING DIELECTRIC CONSTANT OF 6 OR LESS AND YELLOW COUPLER

[75] Inventor: Toyoki Nishijima, Odawara, Japan

[73] Assignee: Konica Corporation, Tokyo, Japan

[21] Appl. No.: 291,750

[22] Filed: Dec. 29, 1988

[30] Foreign Application Priority Data

Jan. 7, 1988 [JP] Japan ..... 63-2076

[51] Int. Cl.[5] ..... G03C 7/34; G03C 7/36

[52] U.S. Cl. ..... 430/546; 430/551; 430/552; 430/553; 430/556; 430/557

[58] Field of Search ..... 430/557, 556, 551, 546, 430/552, 553

[56] References Cited

U.S. PATENT DOCUMENTS

| | | | |
|---|---|---|---|
| 3,676,137 | 7/1972 | Mizuki et al. | 430/546 |
| 4,193,802 | 3/1980 | Mukunoki et al. | 430/546 |
| 4,217,410 | 8/1980 | Nakamura et al. | 430/546 |
| 4,278,757 | 7/1981 | Mukunoki et al. | 430/546 |
| 4,326,022 | 4/1982 | Ito et al. | 430/546 |
| 4,614,709 | 9/1986 | Sasaki et al. | 430/546 |
| 4,684,606 | 8/1987 | Kirshnamurphy | 430/546 |
| 4,728,599 | 3/1988 | Krishnamurphy | 430/546 |
| 4,731,320 | 3/1988 | Sasaki etal. | 430/546 |
| 4,758,501 | 7/1988 | Buckland et al. | 430/557 |

*Primary Examiner*—Richard L. Schilling

*Attorney, Agent, or Firm*—Jordan B. Bierman

[57] ABSTRACT

A silver halide light-sensitive photographic material comprising a support and provided thereon at least one silver halide emulsion layer containing a yellow dye-foming coupler having a formula [A] below and a high boiling organic solvent having a dielectric constant of not more than 6.0;

wherein $R_1$ represents a halogen atom or an alkoxy group having 1 to 4 carbon atoms; $R_2$ represents a hydrogen atom, a halogen atom, an alkyl group or an alkoxy group; $R_3$ and $R_4$ independently represent an alkyl group which is capable of making said coupler non-diffusible in the photographic material; $X_1$ represents a tertiary butyl group or a p-alkoxy phenyl group; $X_2$ represents a hydrogen atom or a group which is capable of being split off during color development; and $X_3$ represents a linking group.

18 Claims, No Drawings

PHOTOGRAPHIC MATERIAL WITH SOLVENT HAVING DIELECTRIC CONSTANT OF 6 OR LESS AND YELLOW COUPLER

FIELD OF THE INVENTION

This invention relates to silver halide light-sensitive photographic materials and, more particularly, to a silver halide light-sensitive photographic material which provides good color fastness to light and good gradation with respect to yellow dye images, and which is less prone to a coating failure.

BACKGROUND OF THE INVENTION

Hindered phenol compounds, as anti-fading agents effective for enhancing color fastness to light of yellow dye images, are disclosed in Japanese Patent Publication Open to Public Inspection (hereinafter referred to as Japanese Patent O.P.I. Publication) Nos. 48535/1979, 3433/1984, 5246/1984, and 87456/1984.

European Patent No. 249,473 discloses yellow couplers having a hindered phenol component incorporated in their molecules.

These prior art techniques can provide fairly good improvement in fastness to light of yellow dye images, which, however, is still insufficient. Further, they have shortcomings that they are likely to produce softer gradation and that they are likely to cause coating failures in the process of manufacturing a silver halide light-sensitive photographic material.

SUMMARY OF THE INVENTION

The object of this invention is to provide a silver halide light-sensitive photographic material which is less prone to a coating failure and which can provide good color fastness to light and good gradation with respect to yellow dye images.

The foregoing object of the invention has been accomplished by a silver halide light-sensitive photographic material comprising a support and provided thereon at least one silver halide emulsion layer containing a yellow dye-forming coupler having a Formula A below and a high boiling organic solvent having a dielectric constant of not more than 6.0;

Formula A

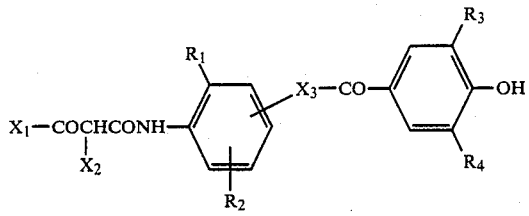

wherein $R_1$ represents a halogen atom or an alkoxy group having 1 to 4 carbon atoms; $R_2$ represents a hydrogen atom, a halogen atom, an alkyl group or an alkoxy group; $R_3$ and $R_4$ independently represent an alkyl group which is capable of rendering said coupler non-diffusibility in said photographic material; $X_1$ represents a tertiary butyl group or a p-alkoxy phenyl group; $X_2$ represents a hydrogen atom or a group which is capable of being split off during color development; and $X_3$ represents a linking group.

DETAILED DESCRIPTION OF THE INVENTION

The invention will now be described in further detail.

For $R_1$, a chlorine atom and a methoxyl group are preferred.

For $R_2$, a hydrogen atom, a chlorine atom, a methyl group, and a methoxy group are preferred.

For $R_3$ and $R_4$, a t-butyl group and t-amyl group are mentioned, for example.

Illustrative of the p-alkoxyphenyl group represented by $X_1$ are, for example, a p-ethoxyphenyl group and a p-butoxyphenyl group.

For the split-off group represented by $X_2$, an aryloxy group and a cyclic acid imide group are preferred.

Illustrative of the bonding group represented by $X_3$ are, for example, an alkylene group, —O—, an alkyleneoxy group, an oxyalkyleneoxy group, a —NH— group and a carbonyloxy alkyleneoxy group.

Particular examples of compounds expressed by the foregoing general formula are shown below, but it is understood that the invention is not limited by them.

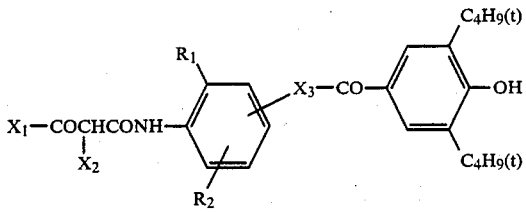

| Yellow coupler | $X_1$ | $X_2$ | $X_3$ | $R_1$ | $R_2$ |
|---|---|---|---|---|---|
| 1 | $(CH_3)_3C$— | —O—⟨benzene⟩—CN | 5-$CH_2O$— | Cl | H |

-continued
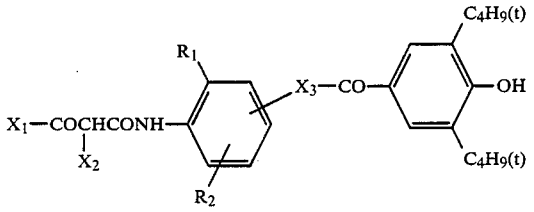
| Yellow coupler | $X_1$ | $X_2$ | $X_3$ | $R_1$ | $R_2$ |
|---|---|---|---|---|---|
| 2 | " | 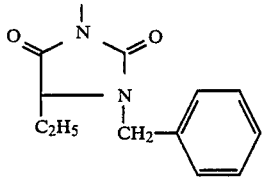 | " | " | " |
| 3 | " | 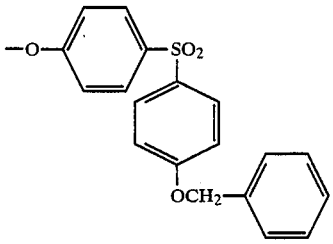 | " | " | " |
| 4 | " | 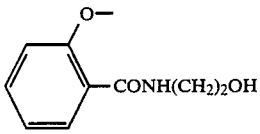 | " | " | " |
| 5 | " | 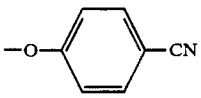 | 5-COO(CH2)2O— | " | " |
| 6 | " | 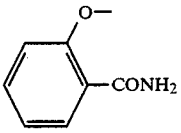 | " | " | " |
| 7 | " | 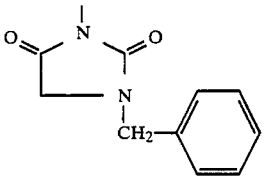 | " | " | " |
| 8 | " | 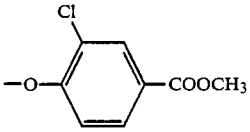 | " | " | " |

-continued
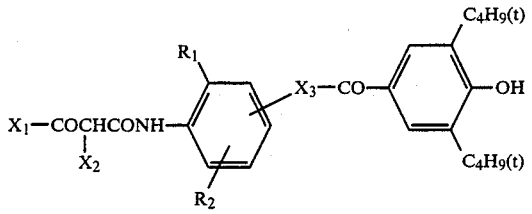
| Yellow coupler | $X_1$ | $X_2$ | $X_3$ | $R_1$ | $R_2$ |
|---|---|---|---|---|---|
| 9 | " | 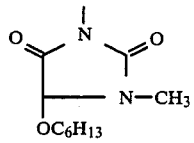 | " | " | " |
| 10 | " | 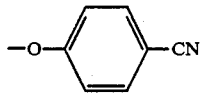 | 5-NH— | " | " |
| 11 | " | 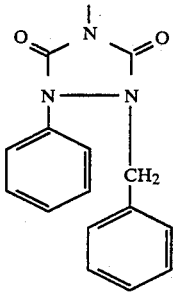 | " | " | " |
| 12 | " | 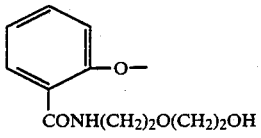 | " | " | " |
| 13 | " | 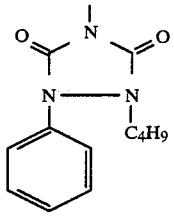 | " | —$OCH_3$ | " |
| 14 | " | 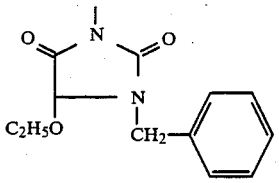 | " | Cl | " |
| 15 | " | 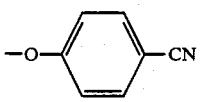 | 4-O— | " | " |
| 16 | " | " | " | " | 5-Cl |

-continued
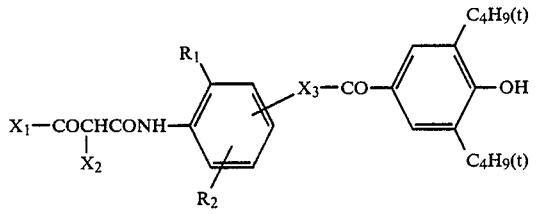
| Yellow coupler | $X_1$ | $X_2$ | $X_3$ | $R_1$ | $R_2$ |
|---|---|---|---|---|---|
| 17 | " | 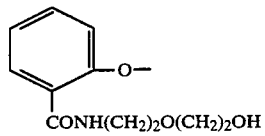 | " | " | " |
| 18 | " | 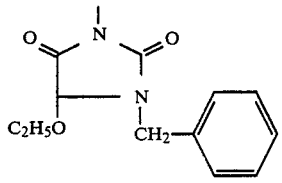 | " | " | " |
| 19 | " | 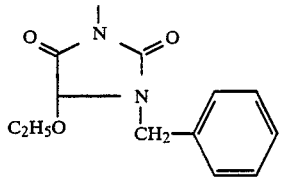 | 5-O— | " | H |
| 20 | " | 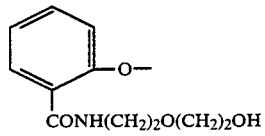 | " | " | " |
| 21 | 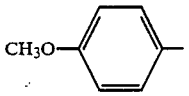 | 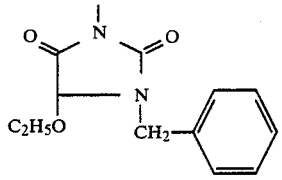 | 5-COO$(CH_2)_2$O— | " | " |
| 22 | 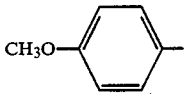 | 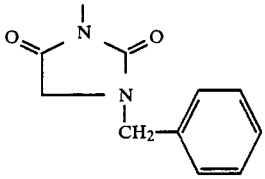 | " | " | " |
| 23 | 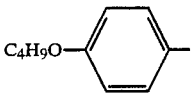 | 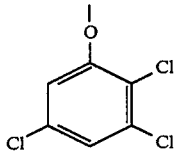 | " | " | " |

-continued

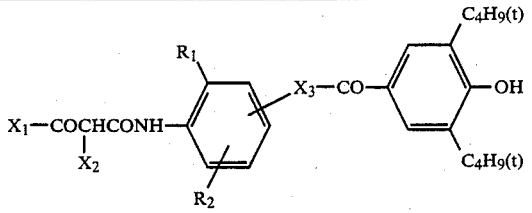

| Yellow coupler | $X_1$ | $X_2$ | $X_3$ | $R_1$ | $R_2$ |
|---|---|---|---|---|---|
| 24 | " | 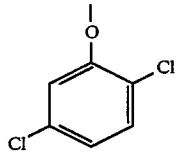 | " | " | " |
| 25 | " | 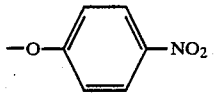 | " | " | " |

The yellow coupler of Formula A can be prepared by a known method, for example, a method in which

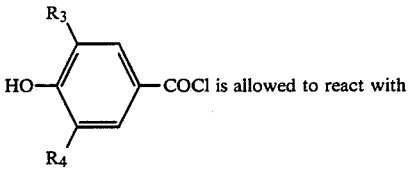

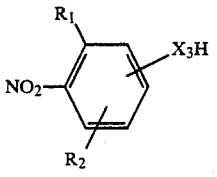

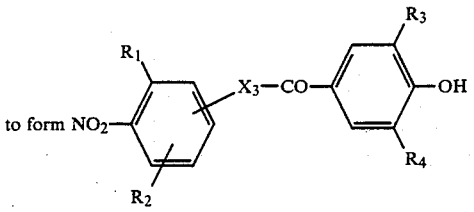

and the nitro group therein is reduced into amine, which is then allowed to react with $X_1COCH_2COOR$ (in which R represents an alkyl, an aryl group, etc.), an $X_2$ group being then introduced into the compound as required.

The yellow coupler of Formula A is used preferably in an amount of $1\times10^{-3}$ mol to 1 mol, more preferably, $1\times10^{-2}$ mol to $8\times10^{-1}$ mol, per mol silver halide.

One important feature of the present invention lies in the use of a high boiling organic solvent having a dielectric constant of not more than 6.0. The organic solvent is not particularly limited in variety. For example, esters such as phthalic ester, phosphoric ester, and benzoic ester, organic amides, ketones, and hydrocarbon compounds - which have a dielectric constant of not more than 6.0, preferably not more than 5.0, especially preferably 4.5 - are mentioned as useful varieties of such organic solvents. Preferably, the high boiling organic solvent in the present invention is any such solvent having a dielectric constant of not more than 6.0 but not less than 1.9 and a vapor pressure of not more than 0.5 mmHg at 100° C. More preferably, it is any of phthalic esters or phosphoric esters within the category of such high boiling organic solvents. The high boiling organic solvent used in the invention may be a mixture of two or more kinds of such solvents.

It is noted that the term "dielectric constant" herein means a dielectric constant at 30° C., and that high boiling means a boiling point of not lower than 150° C.

Phthalic esters that can be advantageously used for the purpose of the invention are those expressed by the following Formula I:

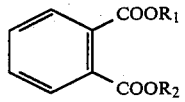

Formula I in which $R_{11}$ and $R_{12}$ independently represent an alkyl group, an alkenyl group, or an aryl group, provided that the total of carbon atoms in the groups expressed by $R_1$ and $R_2$ is 12 to 32, preferably 16 to 24, in particular, 18 to 24.

In the present invention, the alkyl group represented by $R_{11}$ or $R_{12}$ in the foregoing Formula I may be straight-chain groups or branched-chain groups. Examples of such alkyl groups include for example, a butyl group, a pentyl group, a hexyl group, a 2-ethylhexyl group, a 3,5,5-trimethylhexyl group, an octyl group, a nonyl group, a decyl group, a dodecyl group, a tetradecyl group, a hexadecyl group, and an octadecyl group. For the aryl group represented by $R_{11}$ or $R_{12}$, a phenyl group and a naphthyl group are mentioned, for example. For the alkenyl group, for example, a hexenyl group, a heptenyl group, and an octadecenyl group can be mentioned. These alkyl, alkenyl, and aryl groups include those having a single or a plurality of substituent groups. Illustrative of substituent in the alkyl or alkenyl group is, for example, a halogen atom, an alkoxy group, an aryl group, an aryloxy group, an alkenyl group, and an alkoxycarbonyl group. Illustrative substituent in the aryl group includes for example, a halogen atom, an alkyl group, an alkoxy group, an aryl group, an aryloxy group, an alkenyl group, and an alkoxycarbonyl group.

In the above, $R_{11}$ and $R_{12}$ are preferably alkyl groups, for example, selected from a 2-ethylhexyl group, a 3,5,5-trimethylhexyl group, a n-octyl group, and a n-nonyl group.

For phosphoric esters that can be advantageously used in the present invention, those expressed by the following Formula II are mentioned:

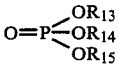

Formula II in which $R_{13}$, $R_{14}$, and $R_{15}$ indepently represent an alkyl group, an alkenyl group, or an aryl group, provided that the total number of carbon atoms contained in the groups $R_{13}$, $R_{14}$, and $R_{15}$ is 24 to 54, preferably 27 to 36.

The alkyl group represented by $R_{13}$, $R_{14}$ or $R_{15}$ in Formula II includes for example, a butyl group, a pentyl group, a hexyl group, a 2-ethylhexyl group, a heptyl group, a nonyl group, a decyl group, a dodecyl group, a tetradecyl group, a hexadecyl group, an octadecyl group, and a nonadecyl group. The aryl group includes for example, a phenyl group and a naphtyl group. The alkenyl group includes for example, a hexenyl group, a heptenyl group, and an octadecenyl group.

These alkyl, alkenyl, and aryl groups include those having a single or a plurality of substituent groups. Preferably, $R_{13}$, $R_{14}$, and $R_{15}$ are alkyl groups selected from, for example, a 2-ethylhexyl group, a n-octyl group, a 3,5,5-trimethylhexyl group, a n-nonyl group, a n-decyl group, a sec-decyl group, a sec-dodecyl group, and a tert-octyl group.

Representative examples of high boiling organic solvents useful for the purpose of the invention are illustrated below, but the scope of the invention is not limited by them.

Example Organic Solvents

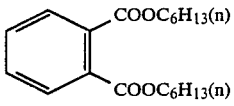

S-1

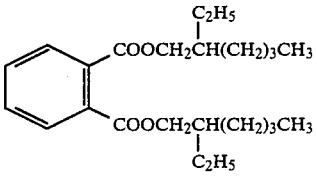

S-2

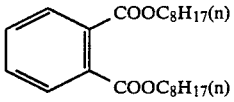

S-3

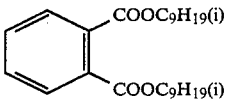

S-4

-continued

Example Organic Solvents

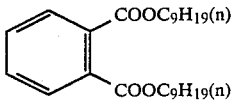

S-5

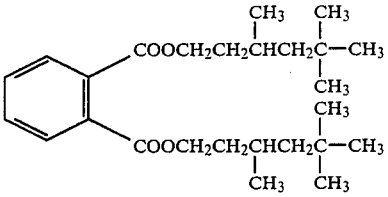

S-6

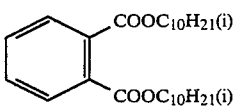

S-7

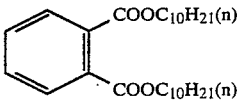

S-8

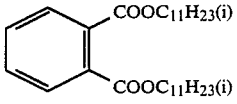

S-9

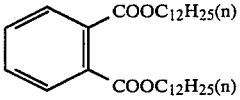

S-10

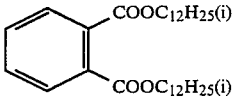

S-11

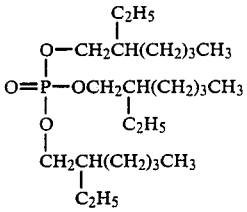

S-12

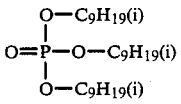

S-13

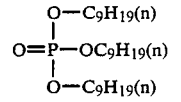

S-14

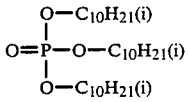

S-15

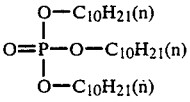

S-16

-continued

Example Organic Solvents

S-17

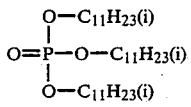

S-18

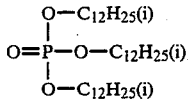

S-19

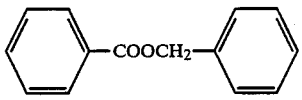

S-20

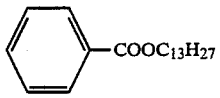

S-21

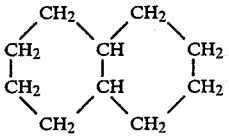

S-22

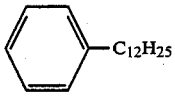

Among these examplified compounds, S-1, S-2, S-3 and S-12 have dielectric constants of between 6 and 5; S-4, S-5, S-6 and S-19 have dielectric constants of between 5 and 4.5; and S-7, S-8, S-9, S-10, S-11, S-13, S-14, S-15, S-16, S-17, S-18, S-20, S-21 and S-22 have dielectric constants of not less than 4.5.

These high boiling organic solvents having a dielectric constant of not more than 6.0 should preferably be used in an amount of 0.1 to 10 ml, especially preferably, 0.1 to 0.5 ml, per gram of coupler.

For addition of the coupler it is preferable to employ an oil-in-water emulsion dispersal method.

To carry out oil-in-water emulsion dispersal, a hydrophobic admixture including the coupler is dissolved in any high boiling organic solvent defined herein and using in combination therewith, as required, a low boiling organic solvent, a high boiling organic solvent other than any defined as such herein, and/or a water soluble solvent, and the resulting solvent solution is emulsified and dispersed in a hydrophilic binder, such as aqueous gelatin, with a surfactant and by employing dispersion means, such as an agitator, a homogenizer, a colloid mill, a flow jet mixer, or an ultrasonic dispersion device. The resulting dispersion is then added into a target hydrophilic colloidal layer. The above process may include the step of removing the low boiling organic solvent from the dispersion liquid or immediately upon dispersion being effected.

For high boiling organic solvents that may be used in combination with any of the high boiling organic solvents according to the invention, organic solvents having a boiling point of higher than 150° C. which are not likely to react with an oxidation product that may be present in a developer may be mentioned, for example, phenolic derivatives, phthalic esters, phosphoric esters, citric esters, benzoic esters, alkylamides, fatty esters, and trimesic esters.

The silver halide light-sensitive photographic material according to the invention can be used for either monocolor or multicolor photography. In the case where it is used for multicolor photography, magenta and cyan dye-forming couplers are normally used in addition to the yellow coupler.

Nextly, magenta and cyan couplers which are preferably used in the present invention will be explained.

For magenta couplers useful in the practice of the invention, 5-pyrazolone, pyrazolobenzimidazole, pyrazoloazole, and open-chain acylacetonitrile couplers are mentioned and, inter alia, 5-pyragolone and pyrazolotriazole magenta couplers are preferred.

Typical examples of useful magenta couplers are shown below.

M-1

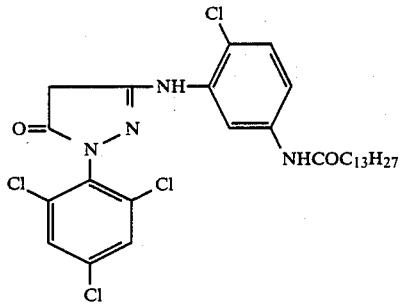

-continued
M-2
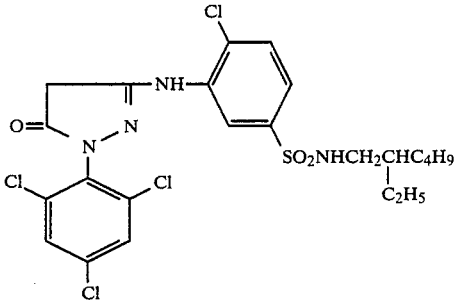
M-3
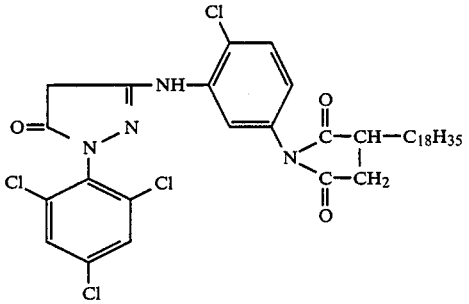
M-4
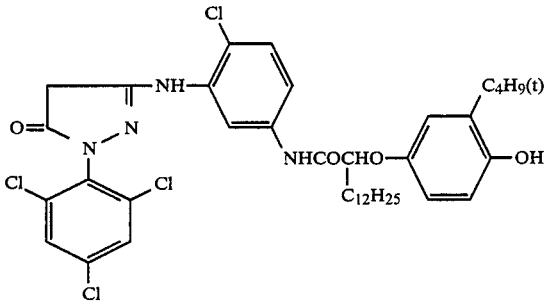
M-5
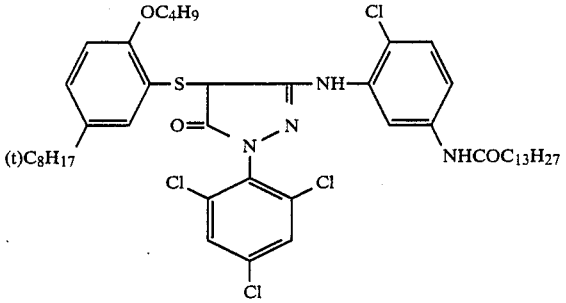
M-6
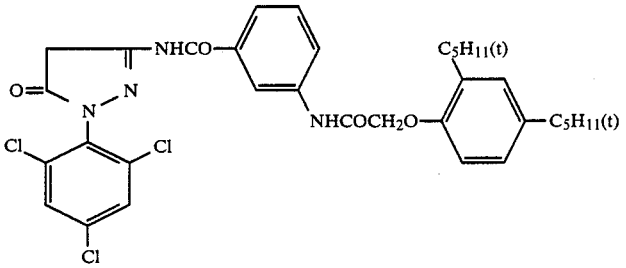

-continued
M-7
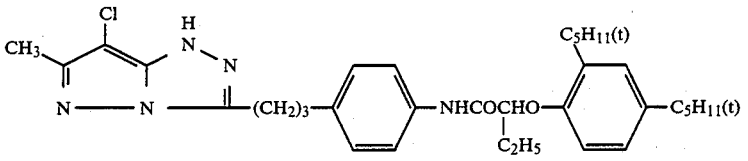
M-8
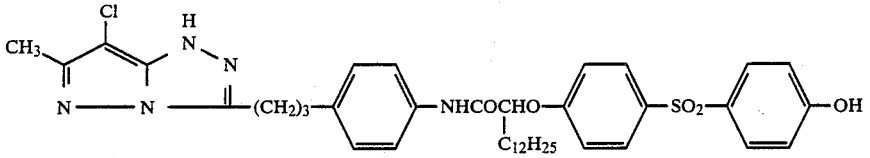
M-9
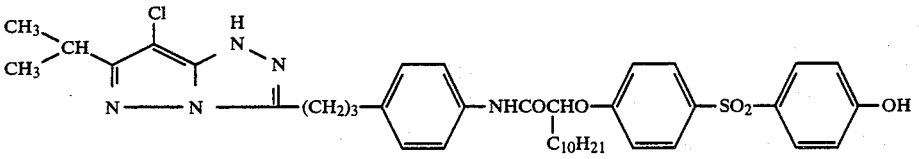
M-10
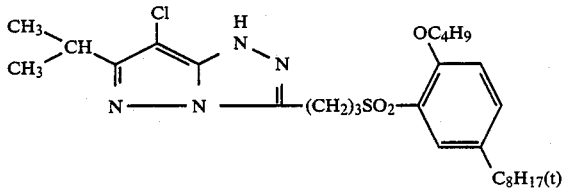
M-11
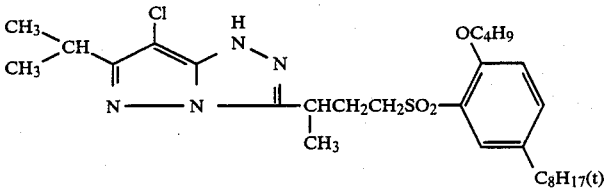
M-12
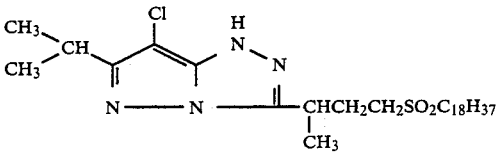
M-13
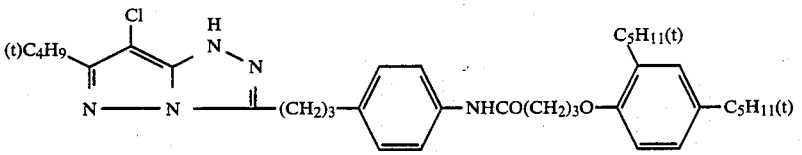
M-14
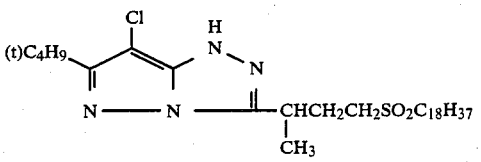
M-15
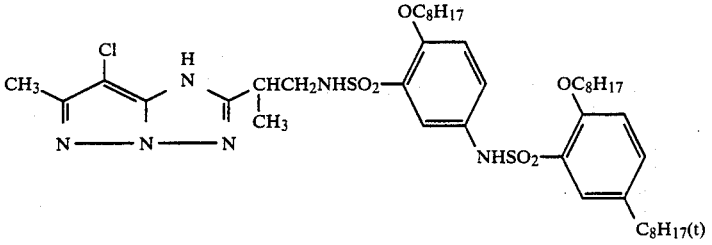

-continued

M-16

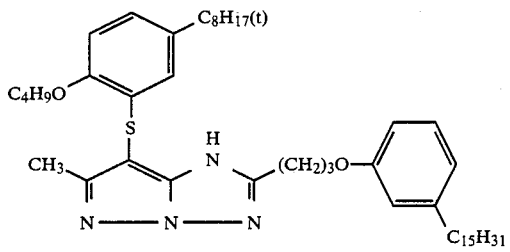

These magenta couplers are disclosed in, for example, Japanese Patent O.P.I. Publication Nos. 111631/1974, 133734/1981, 143337/1985, 90155/1986, 158329/1986, 189540/1986, 38463/1987 and 59953/1987 and U.S. Pat. Nos. 3,519,429 and 3,684,514.

For cyan couplers useful in the practice of the invention, phenol and naphthol couplers are mentioned and, inter alia, 2,5-diacylaminophenol and 3-alkyl-6-acylaminophenol cyan couplers are preferred.

Typical examples of cyan couplers are shown below.

C-1

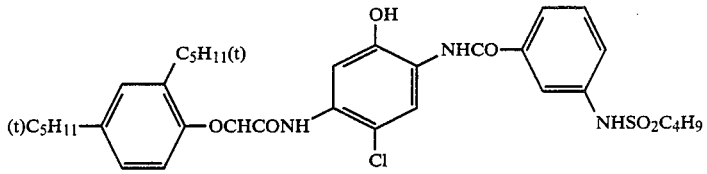

C-2

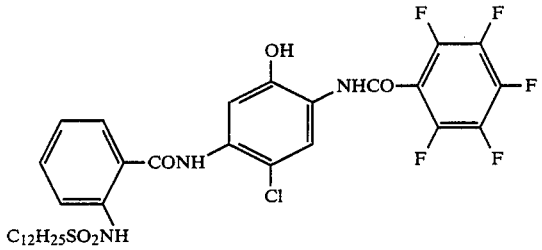

C-3

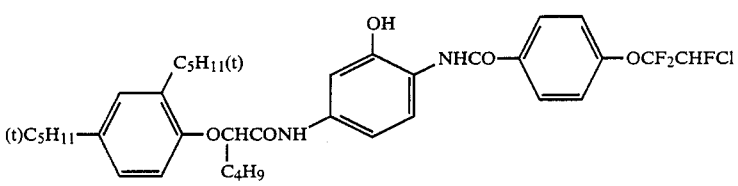

C-4

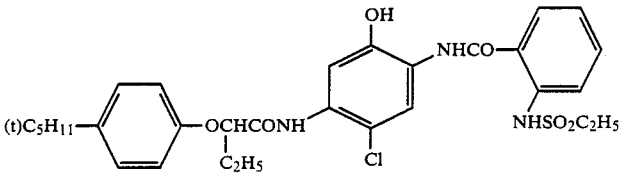

C-5

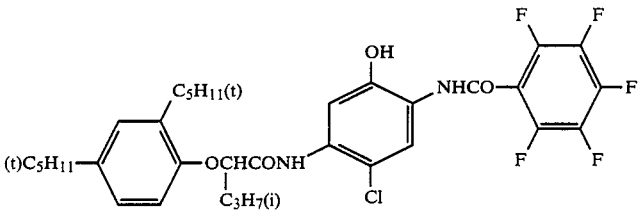

-continued

C-6

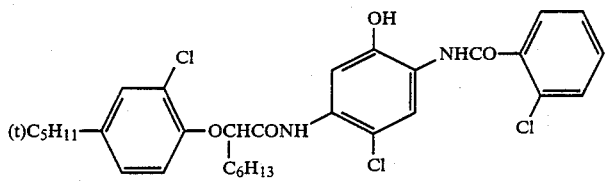

C-7

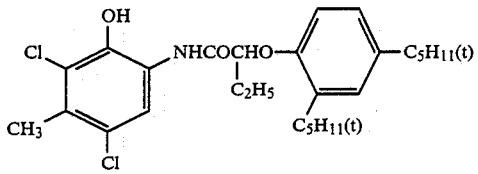

C-8

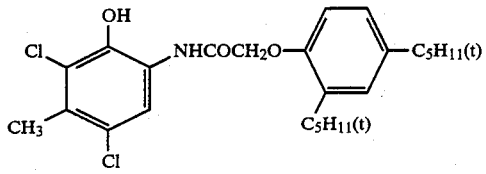

C-9

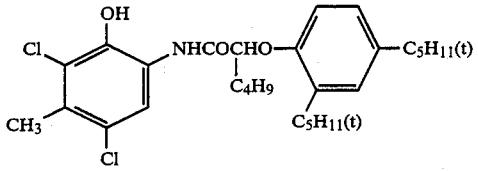

C-10

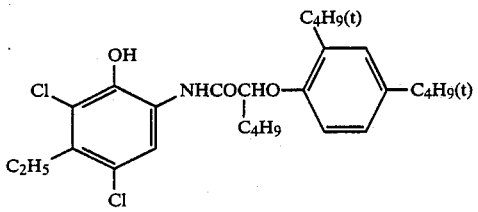

C-11

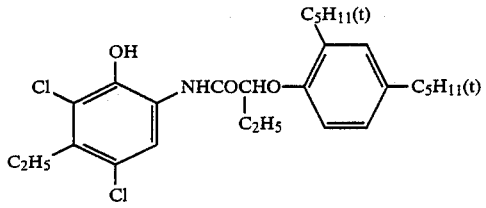

C-12

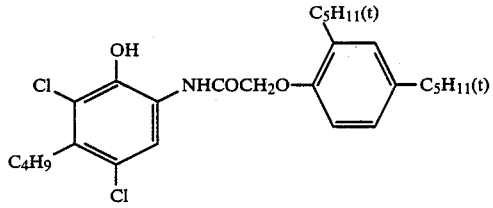

These cyan couplers are disclosed in, for example, Japanese Patent O.P.I. Publication Nos. 146050/1984, 117249/1985 and 31953/1984. In the present invention, cyan couplers mentioned in U.S. Pat. Nos. 2,423,730 and 4,564,590, and Japanese Patent O.P.I. Publication Nos. 222853/1985, 36746/1986, 98348/1986, 167953/1986, 10649/1987, and 30251/1987 may also be used.

The above enumerated magenta and cyan couplers can be used normally in an amount of $1\times10^{-3}$ mol to 1 mol, preferably, $1\times10^{-2}$ mol to $8\times10^{-1}$ mol, per mol silver halide.

To effect addition of such magenta and cyan couplers, it is preferable, as is the case with the above described yellow couplers, to employ the oil-in-water emulsion dispersal method.

The silver halide light-sensitive photographic material according to the invention may be, for example, a color negative film, a color positive film, or color photographic paper, for either monocolor photography or multicolor photography.

In the case where the silver halide light-sensitive photographic material is for multicolor photography, it usually has a construction such that silver halide emulsion layers which individually contain magenta, yellow, and cyan couplers, and non-light-sensitive layers are placed one over another on a support base, in appropriate numbers of and in a given order of layers; however, the numbers of layers and the order of layer placement may be changed as required according to the order of priority in performance, as well as the intended purpose for use of the light-sensitive material.

For the silver halide used in the silver halide light-sensitive photographic material according to the invention, any of those compounds which are used in conventional silver halide emulsions may be used, such as silver bromide, silver iodobromide, silver iodochloride, silver chlorobromide, and silver chloride.

The silver halide emulsion used in the present invention can be subjected to a chemical sensitization by a conventionally known process, such as sulfur sensitization, selenium sensitization, reduction sensitization or noble metal sensitization.

The silver halide emulsions useful in the practice of the present invention can be optically sensitized to a desired wave range by using dyes known as sensitizing dyes in the art of photography.

In the silver halide light-sensitive photographic material according to the invention, gelatin can be advantageously used as a binder (or protective colloid). Among other materials useful as such are gelatin derivatives, graft polymers of gelatin with other polymeric materials, proteins, sugar derivatives, cellulose derivatives, and hydrophilic colloids of synthetic polymer materials, such as hydrophilic homopolymers or copolymers.

Further, in the silver halide light-sensitive photographic material of the invention, it is possible to use as required various known additives, such as hardener, anti-stain agent, image stabilizer, plasticizer, latex, surfactant, matting agent, lubricant, and antistatic agent.

The silver halide light-sensitive photographic material of the invention produces an image thereon by being subjected to a color development process known in the art.

EXAMPLES

The following examples are given to further illustrate the invention, but it is to be understood that the mode of carrying out the invention is in no way limited to these examples.

EXAMPLE 1

100 g of yellow coupler (comparative Y coupler 1) was dissolved in a mixed solvent consisting of 100 ml of dibutyl phthalate (DBP), a high boiling solvent (HBS), and 200 ml of ethyl acetate, and the resulting solvent solution was added to a 5% aqueous solution of gelatin containing sodium dodecylbenzene sulfonate, a dispersing agent, being dispersed therein by means of a homogenizer. The dispersion thus obtained was finished up to 2,000 ml and same was kept at 35° C. This dispersion was added to 1,000 ml of a 3% aqueous coating solution of gelatin, and to the mixture was added 400 g of a blue-sensitive silver chlorobromide emulsion (containing 80 mol % of silver bromide, with a silver weight of 30 g). A coating emulsion was thus prepared. The emulsion was kept at 35° C.

This coating emulsion was coated on a polyethylene-covered paper support base so as to give a layer thickness of 30 μm. Then, a coating emulsion containing gelatin, a spreading agent, and a hardener was coated on the emulsion layer to form a protective layer. The test sample thus obtained was designated Sample No. 1.

Sample Nos. 2 through 18 were prepared in a way same as Sample No. 1 except that the coupler and the high boiling organic solvent were varied from those in Sample No. 1, as shown in Table 1.

Individual test samples thus obtained were subjected to wedge exposure to blue light by employing a sensitometer (model KS-7, made by Konica Corporation), and were then passed through the following processing stages.

| Processing Stage | Processing Temp. | Processing Time |
|---|---|---|
| Color development | 32.8° C. | 3 min. 30 sec. |
| Bleach-fixing | 32.8° C. | 1 min. 30 sec. |
| Washing | 32.8° C. | 3 min. 30 sec. |

| (Composition of Color Developer) | |
|---|---|
| N-ethyl-N-β-methanesulfonamidoethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Anhydrous sodium sulfite | 2.0 g |
| Benzyl alcohol | 10.0 ml |
| Polyethylene glycol (mean degree of polymerization, 400) | 3.0 ml |

Water was added to give a total volume of 1 lit., and the pH was adjusted to 10.0 with sodium hydroxide.

| (Composition of bleach-fix bath) | |
|---|---|
| Ferric sodium ethylenediaminetetraacetate | 60.0 g |
| Sodium thiosulfate | 100.0 g |
| Sodium bisulfite | 20.0 g |
| Sodium metabisulfite | 5.0 g |

Water was added to give a total volume of 1 lit., and the pH was adjusted to 7.0 with sulfuric acid.

Yellow dye images obtained were evaluated on their fastness to light in the following way. Also, measurements were made of their sensitometry characteristics (based on gradation in a density range of 0.8 to 1.8) and of numbers of coating failures per 10 $m^2$ of layer surface in them.

(Fastness to light)

With the yellow dye image formed on each individual test sample, measurement was made by employing a sunlight tracer exposure apparatus to determine the degree of fading $$\frac{D_0 - D}{D_0} \times 100(\%)$$

(in which $D_0$ represents initial density (1.0) and D represent post-exposure density) when the yellow image has been subjected to exposure through an ultraviolet absorbing filter for ten days.

TABLE 1

| Sample No. | Y coupler | HBS (dielectric constant) | HBS/Y coupler (ml/g) | Anti-fading agent | Degree of fading | Gradation (γ) | Number of failures |
|---|---|---|---|---|---|---|---|
| 1 (Comparative) | Comparative Y coupler 1 | DBP (6.4) | 1.0 | No addition | 93 | 3.30 | 15 |
| 2 (Comparative) | Comparative Y coupler 1 | DOP (5.3) | 1.0 | No addition | 92 | 3.27 | 13 |
| 3 (Comparative) | Comparative Y coupler 2 | DBP | 1.0 | No addition | 59 | 3.29 | 14 |
| 4 (Comparative) | Comparative Y coupler 2 | DOP | 1.0 | No addition | 66 | 3.25 | 14 |
| 5 (Comparative) | Comparative Y coupler 2 | DBP | 1.0 | A | 37 | 3.01 | 500 and above |
| 6 (Comparative) | Comparative Y coupler 2 | DBP | 1.0 | B | 35 | 2.97 | 1000 and above |
| 7 (Comparative) | Comparative Y coupler 2 | DOP | 1.0 | B | 32 | 2.89 | 1000 and above |
| 8 (Comparative) | Comparative Y coupler 2 | DINP (4.6) | 1.0 | B | 30 | 2.90 | 1000 and above |
| 9 (Comparative) | 18 | DEP (7.6) | 1.0 | No addition | 45 | 3.05 | 500 and above |
| 10 (Invention) | 18 | DOP | 1.0 | No addition | 23 | 3.25 | 15 |
| 11 (Invention) | 18 | DINP | 1.0 | No addition | 18 | 3.31 | 13 |
| 12 (Invention) | 18 | DINP | 0.5 | No addition | 14 | 3.30 | 12 |
| 13 (Invention) | 18 | DLP (4.2) | 0.5 | No addition | 15 | 3.29 | 10 |
| 14 (Invention) | 18 | TINP (4.5) | 0.5 | No addition | 15 | 3.32 | 13 |
| 15 (Invention) | 1 | DINP | 0.5 | No addition | 14 | 3.31 | 10 |
| 16 (Invention) | 3 | DINP | 0.5 | No addition | 17 | 3.33 | 8 |
| 17 (Invention) | 10 | DINP | 0.5 | No addition | 15 | 3.30 | 11 |
| 18 (Invention) | 17 | DINP | 0.5 | No addition | 10 | 3.33 | 10 |

Anti-fading agent (added in an amount of 1 mol per mol Y coupler)

A

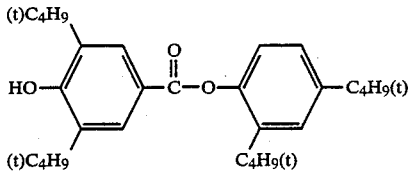

B

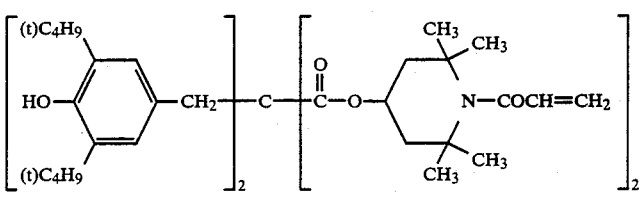

Comparative Y coupler 1

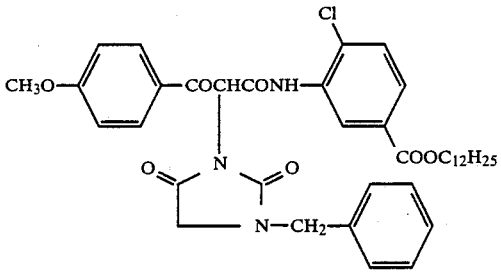

Comparative Y coupler 2

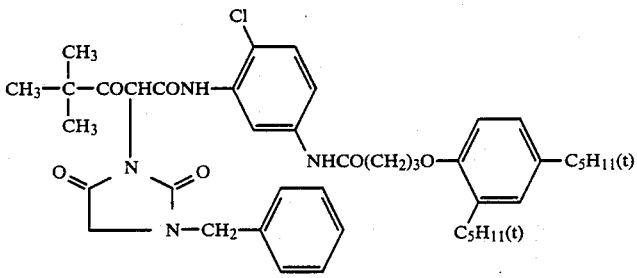

DOP: di-2-ethylhexyl phthalate
DINP: diisononyl phthalate
DEP: diethyl phthalate
DLP: di-n-lauryl phthalate
TINP: triisononyl phosphate.

As is apparent from Table 1, where a coupler of Formula A is used in combination with a high boiling organic solvent according to the invention, there occurs no coating failure or deterioration in gradation, and the coupler and the high boiling organic solvent produce a synergistic effect to provide improved fastness to light. Whilst, with the systems in which a comparative Y-coupler is used in combination with an anti-fading agent and those in which a coupler of Formula A is used alone, some improvement in color fastness to light can be had, but still insufficient, and deterioration in gradation and coating failures are likely to occur.

With test samples according to the invention in which a phthalic ester having a total carbon atom number of 18 to 24 in its alcohol portion and a phosphoric ester having a total carbon atom number of 27 to 36 in its alcohol portion are used as high boiling organic solvents, and also with those in which the ratio of volume of the high boiling organic solvent/weight of the coupler is not more than 0.5, it is clearly seen that the advantage of the invention is particularly conspicuous.

Sample No. 18, in which $X_2$ is

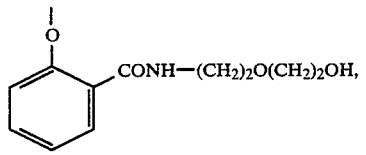

was found as having especially good color fastness to light.

With samples in which S-1, S-12, S-19, and S-22 were used in place of HBS in sample No. 10, good effect of the invention was observed as well.

EXAMPLE 2

Individual layers mentioned below were sequentially laid by coating on a corona-discharge processed, polyethylene covered paper support base, in order to proximity to the support base, and a color light-sensitive material was thus obtained.

FIRST LAYER: BLUE-SENSITIVE EMULSION LAYER

Coating was made so as to give coating buildups of 8 mg/dm$^2$ of yellow coupler (comparative Y coupler 1), 3 mg/dm$^2$ of blue sensitive silver chlorobromide emulsion (containing 20 mol % of silver chloride and 80 mol % of silver bromide) in terms of silver weight, 3 mg/dm$^2$ of high boiling organic solvent (DBP), and 16 mg/dm$^2$ of gelatin.

SECOND LAYER: INTERMEDIATE LAYER

Coating was made so as to give coating buildups of 0.45 mg/dm$^2$ of a hydroquinone derivative (HQ-1) and 4 mg/dm$^2$ of gelatin.

THIRD LAYER: GREEN-SENSITIVE EMULSION LAYER

Coating was made so as to give coating buildups of 4 mg/dm$^2$ of magenta coupler (M-3), 2 mg/dm$^2$ of green-sensitive silver chlorobromide emulsion (containing 20 mol % of silver chloride and 80 mol % of silver bromide) in terms of silver weight, 4 mg/dm$^2$ of high boiling organic solvent (dioctyle phthalate), 4 mg/dm$^2$ of an anti-fading agent (AO-1), and 16 mg/dm$^2$ of gelatin.

FOURTH LAYER: INTERMEDIATE LAYER

Coating was made so as to give coating buildups of 3 mg/dm$^2$ of an ultraviolet absorbing agent (UV-1), 3 mg/dm$^2$ of an ultraviolet absorbing agent (UV-2), 4 mg/dm$^2$ of high boiling organic solvent (DNP), 0.45 mg/dm$^2$ of a hydroquinone derivative (HQ-2), and 14 mg/dm$^2$ of gelatin.

FIFTH LAYER: RED-SENSITIVE EMULSION LAYER

Coating was made so as to give coating buildups of 2 mg/dm$^2$ of cyan coupler (C-5), 2 mg/dm$^2$ of (C-7), 4 mg/dm$^2$ of dioctyl phthalate, 3 mg/dm$^2$ of red-sensitive silver chlorobromide emulsion (containing 20 mol % of silver chloride and 80 mol % of silver bromide) in terms of silver weight, and 14 mg/dm$^2$ of gelatin.

SIXTH LAYER: INTERMEDIATE LAYER

Coating was made so as to give coating buildups of 4 mg/dm$^2$ of an ultraviolet absorbing agent (UV-3), 0.2 mg/dm$^2$ of HQ-1, 2 mg/dm$^2$ of DNP, and 6 mg/dm$^2$ of gelatin.

SEVENTH LAYER: PROTECTIVE LAYER

Coating was made so as to give a coating buildup of 9 mg/dm$^2$ of gelatin.

(Compounds used in the preparation of test samples)

DNP: dinonyl phthalate

AO-1

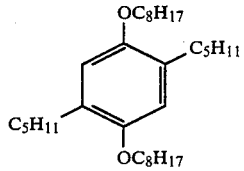

HO-1

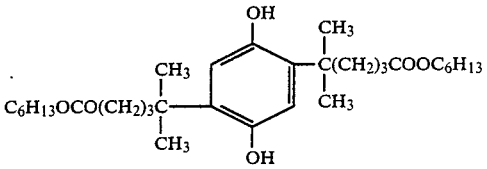

HO-2

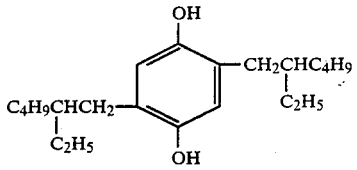

UV-1

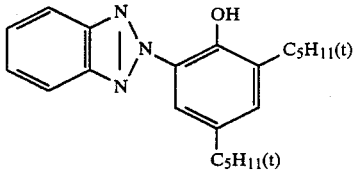

UV-2

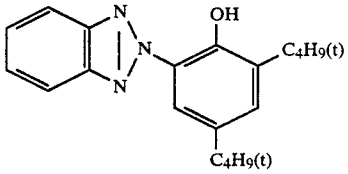

-continued (Compounds used in the preparation of test samples)

DNP: dinonyl phthalate

UV-3

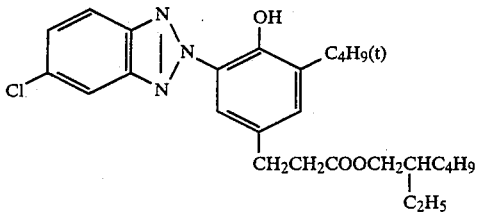

The light-sensitive material obtained was designated Sample No. 19.

Individual test samples were prepared in same way as sample No. 19 except that different yellow couplers and high boiling solvents were used in such combinations as shown in Table 2.

These test samples were exposed to light and processed, and evaluated in same manner as in Example 1.

-continued

| | |
|---|---|
| High boiling organic solvent (DBP) | 0.06 |
| ArBrI (AgI 3.0 mol %, mean grain size 0.4 μm) spectrally sensitized by red sensitizing dyes (D-1, D-2) | 0.14 |
| Gelatin | 1.0 |
| Fourth Layer (second red-sensitive layer) | |
| Cyan coupler C-11 | 0.10 |
| Cyan coupler C-5 | 0.20 |
| High boiling organic solvent (DBP) | 0.10 |
| ArBrI (Aryl 3.0 mol %, mean grain size 0.8 μm) spectrally sensitized by red sensitizing dyes (D-1, D-2) | 0.16 |
| Gelatin | 1.0 |
| Fifth Layer (first intermediate layer) | |
| Gelatin | 1.0 |
| Color mix inhibitor (AN-1) | 0.08 |
| Sixth Layer (first green-sensitive layer) | |
| Magenta coupler (M-3) | 0.14 |
| High boiling organic solvent (TCP) | 0.15 |
| AgBrI (AgI 3.0 mol %, mean grain size 0.4 μm) spectrally sensitized by green sensitizing dye (D-3) | 0.15 |
| Gelatin | 1.0 |
| Seventh Layer (second green-sensitive layer) | |
| Magenta coupler (M-3) | 0.14 |
| High boiling organic solvent (TCP) | 0.15 |
| AgBrI (AgI 3.0 mol %, mean grain size 0.7 μm) spectrally sensitized by green sensitizing dye (D-3) | 0.15 |
| Gelatin | 1.0 |
| Eighth Layer (second intermediate layer) | |
| Yellow colloidal silver | 0.15 |
| Color mix inhibitor (AN-1) | 0.08 |
| Gelatin | 1.0 |
| Ninth Layer (first blue sensitive layer) | |
| Yellow coupler 18 | 0.40 |
| High boiling organic solvent (TILP) | 0.10 |
| ArBrI (AgI 3.0 mol %, mean grain size 0.4 μm) spectrally sensitized by blue sensitizing dye (D-4) | 0.15 |
| Gelatin | 0.70 |
| Tenth Layer (second blue sensitive layer) | |
| Yellow coupler 18 | 0.80 |
| High boiling organic solvent (TILP) | 0.20 |
| AgBrI (AgI 3.0 mol %, mean grain size 0.8 μm) spectrally sensitized by blue sensitizing dye (D-4) | 0.20 |
| Gelatin | 1.3 |
| Eleventh Layer (UV Absorbing layer) | |
| Ultraviolet absorber U-1 | 0.2 |
| Ultraviolet absorber U-2 | 0.2 |
| Ultraviolet absorber U-3 | 0.2 |
| Ultraviolet absorber U-4 | 0.2 |
| Gelatin | 2.0 |
| Twelfth Layer (protective layer) | |
| Gelatin | 1.0 |

TABLE 2

| Sample No. | Y coupler | HBS (dielectric constant) | Anti-fading agent | Degree of fading | Gradation (γ) | Number of failures |
|---|---|---|---|---|---|---|
| 19 (Comparative) | Comparative Y coupler 2 | DBP | No addition | 64 | 3.32 | 18 |
| 20 (Comparative) | Comparative Y coupler 2 | DOP | No addition | 62 | 3.32 | 16 |
| 21 (Comparative) | Comparative Y coupler 2 | DOP | B | 33 | 2.91 | 1000 and above |
| 22 (Comparative) | 18 | DBP | No addition | 44 | 3.09 | 500 and above |
| 23 (Comparative) | 18 | DBP | No addition | 43 | 3.11 | 500 and above |
| 24 (Comparative) | 18 | TCP (6.9) | No addition | 42 | 3.01 | 1000 and above |
| 25 (Invention) | 18 | DOP | No addition | 21 | 3.33 | 25 |
| 26 (Invention) | 18 | DINP | No addition | 16 | 3.34 | 17 |
| 27 (Invention) | 18 | DLP | No addition | 17 | 3.33 | 16 |
| 28 (Invention) | 18 | TINP | No addition | 18 | 3.35 | 16 |
| 29 (Invention) | 18 | TIDP (4.3) | No addition | 18 | 3.34 | 17 |
| 30 (Invention) | 18 | TILP (3.9) | No addition | 18 | 3.34 | 14 |

TCP: Tricresyl phosphate
TIDP: Triisodecyl phosphate
TILP: Triisododecyl phosphate As is apparent from Table 2, test samples according to the invention exhibited good fastness to light and proved to be significantly less liable to deterioration in gradation and coating failure; and after fastness to light testing, they presented clear and highly defined images. When Y couplers 7, 9, 11, 13, 20, 22, and 23 were used in place of Y coupler 18 in Sample No. 26, it was found that there was little, if any deterioration in gradation and few failures, if any; and even after fastness to light testing, the samples presented clear and well defined images. Thus, the advantageous effect of the invention was confirmed.

EXAMPLE 3

Layers, first to twelfth, mentioned below were sequentially placed on a both-side polyethylene coated paper support base, whereby color reversal light-sensitive material samples were prepared. Coating build-up of each component is shown in g/m$^2$ except that of silver halide is shown in terms of silver weight.

| | |
|---|---|
| First Layer (gelatin layer) | |
| Gelatin | 1.40 |
| Second Layer (anti-halation layer) | |
| Black colloidal silver | 0.10 |
| Gelatin | 0.60 |
| Third Layer (first red-sensitive layer) | |
| Cyan coupler C-11 | 0.07 |
| Cyan coupler C-5 | 0.14 |

It is to be noted that the layers contain, in addition to the above, such agents as anti-fading agent, surfactant, hardener, anti-irradiation dye.

The couplers were individually dissolved in a high boiling solvent and added through dispersion.

Hardener

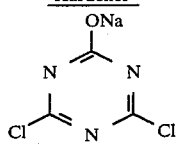

D-1

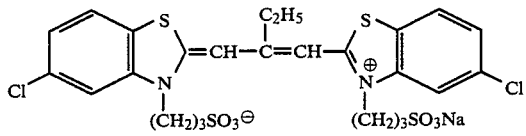

D-2

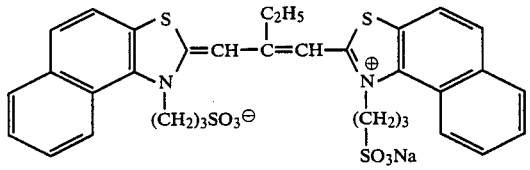

D-3

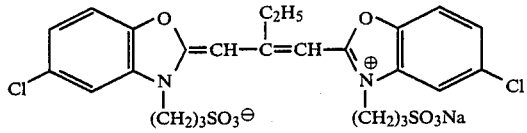

D-4

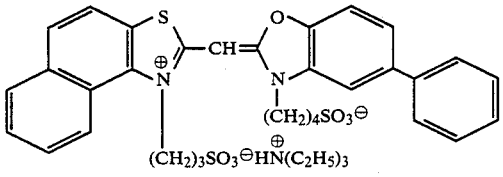

Ultraviolet absorbing agents

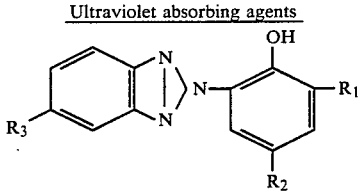

| | $R_1$ | $R_2$ | $R_3$ |
|---|---|---|---|
| U-1 | (t)$C_4H_9$ | (t)$C_4H_9$ | H |
| U-2 | (t)$C_4H_9$ | $CH_3$ | Cl |
| U-3 | (t)$C_4H_9$ | (t)$C_4H_9$ | Cl |
| U-4 | (t)$C_5H_{11}$ | (t)$C_5H_{11}$ | H |

Anti-color stain agent (AN-1)

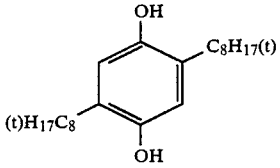

Test samples prepared as above were evaluated in same manner as in Example 1, except that the following stages were employed for their processing. The advantageous effects of the invention were confirmed.

| | |
|---|---|
| First development (monochrome development) | 1 min. 15 sec. (38° C.) |
| First washing | 1 min. 30 sec. |
| Optical fogging | |
| 100 lux and over | 1 sec. or more |
| Second development (color development) | 2 min. 15 sec. (38° C.) |
| Second washing | 45 sec. |
| Bleach-fixing | 2 min. (38° C.) |
| Third washing | 2 min. 15 sec. |

Respective compositions of processing liquids used were as follows:

| | |
|---|---|
| (First Developer) | |
| Potassium sulfite | 3.0 g |
| Sodium thiocyanate | 1.0 g |
| Sodium bromide | 2.4 g |
| Potassium iodide | 8.0 mg |
| Potassium hydroxide (48%) | 6.2 ml |
| Potassium carbonate | 14 g |
| Sodium bicarbonate | 12 g |
| 1-phenyl-4-methyl-4-hydroxy methyl-3-pyrazolidone | 1.5 g |
| Hydroquinone monosulfonate | 23.3 g |
| Water was added to a total amount of 1 lit., the pH being adjusted to 9.65. | |
| (Color Developer) | |
| Benzyl alcohol | 14.6 ml |
| Ethylene glycol | 12.6 ml |
| Potassium carbonate (anhydrous) | 26 g |
| Sodium hydroxide | 1.4 g |
| Sodium sulfite | 1.6 g |
| 3,6-dithiaoctane-1,8-diol | 0.24 g |
| Hydroxylamine sulfate | 2.6 g |
| 4-N-ethyl-N-β-(methane sulfonamide ethyl) -2-methyl-p-phenylenediamine sequisulfate | 5.0 g |
| Add water to make the total volume of 1 l | |
| (Bleach-Fixer) | |
| 1.56 mol solution of ammonium salt of ethylenediamine tetraacetoferric complex | 115 ml |
| Sodium metabisulfite | 15.4 g |
| Ammonium thiosulfate (58%) | 126 ml |
| 1,2,4-triazole-3-thiol | 0.4 g |
| Water was added to a total amount of 1 lit., the pH being adjusted to 6.5. | |

By using the yellow coupler expressed by Formula A in combination with the high boiling organic solvent having a dielectric constant of not more than 6.0, there was obtained a silver halide light-sensitive photographic material capable of exhibiting good fastness to light, good gradation and less liable to coating failure.

What is claimed is:

1. A silver halide light-sensitive photographic material comprising a support and provided thereon at least one silver halide emulsion layer containing a yellow dye-forming coupler having a formula [A] below and a high boiling organic solvent having a dielectric constant of not more than 6.0;

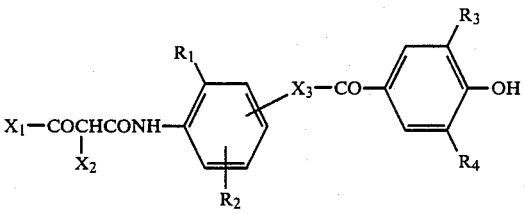

[A]

wherein $R_1$ represents a halogen atom or a substituted or unsubstituted alkoxy group having 1 to 4 carbon atoms; $R_2$ represents a hydrogen atom, a halogen atom, a substituted or unsubstituted alkyl group or a substituted or unsubstituted alkoxy group; $R_3$ and $R_4$ independently represent a substituted or unsubstituted alkyl group which is capable of making said coupler non-diffusible in the photographic material; $X_1$ represents a substituted or unsubstituted tertiary butyl group or a substituted or unsubstituted p-alkoxy phenyl group; $X_2$ represents a hydrogen atom or a group which is capable of being split off during color development; and $X_3$ represents a linking group.

2. The silver halide light-sensitive photographic material of claim 1, wherein said high boiling organic solvent has a dielectric constant of not more than 5.0.

3. The silver halide light-sensitive photographic material of claim 1, wherein said high boiling organic solvent has a dielectric constant of not more than 4.5.

4. The silver halide light-sensitive photographic material of claim 1, wherein said high boiling organic solvent is a phthalic acid ester represented by formula [I] or a phosphoric acid ester represented by formula [II];

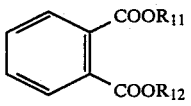

[I]

wherein $R_{11}$ and $R_{12}$ are independently selected from a substituted or unsubstituted alkyl group, a substituted or unsubstituted alkenyl group and a substituted or unsubstituted aryl group, provided that the total number of carbon atoms contained in $R_{11}$ and $R_{12}$ is 12 to 32;

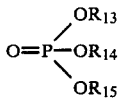

[II]

wherein $R_{13}$, $R_{14}$ and $R_{15}$ are independently selected from the group consisting of a substituted or unsubstituted alkyl group, a substituted or unsubstituted alkenyl group and a substituted or unsubstituted aryl group, provided that the total number of carbon atoms contained in $R_{13}$, $R_{14}$ and $R_{15}$ is 24 to 54.

5. The silver halide light-sensitive photographic material of claim 4, wherein said high boiling organic solvent has a dielectric constant of not more than 5.0.

6. The silver halide light-sensitive photographic material of claim 5, wherein said high boiling organic solvent has a dielectric constant of not more than 4.5.

7. The silver halide light-sensitive photographic material of claim 4, wherein each of $R_1$ and $R_2$ is an alkyl group having 10 to 12 carbon atoms.

8. The silver halide light-sensitive photographic material of claim 1, wherein the content of said high boiling organic solvent is from 0.1 ml to 0.5 ml per 1 g of said coupler.

9. The silver halide light-sensitive photographic material of claim 2, wherein the content of said high boiling organic solvent is from 0.1 ml to 0.5 ml per 1 g of said coupler.

10. The silver halide light-sensitive photographic material of claim 3, wherein the content of said high boiling organic solvent is from 0.1 ml to 0.5 ml per 1 g of said coupler.

11. The silver halide light-sensitive photographic material of claim 1, wherein $R_1$ is a chlorine atom or a methoxy group.

12. The silver halide light-sensitive photographic material of claim 1, wherein $R_2$ is selected from the group consisting of a hydrogen atom, a chlorine atom and a methoxy group.

13. The silver halide light-sensitive photographic material of claim 1, wherein $R_3$ and $R_4$ are independently selected from the group consisting of a t-butyl group and a t-amyl group.

14. The silver halide light-sensitive photographic material of claim 1, wherein $X_1$ is an alkoxyphenyl group.

15. The silver halide light-sensitive photographic material of claim 1, wherein $X_2$ is selected from the group consisting of an aryloxy group and a cyclicacidimide group.

16. The silver halide light-sensitive photographic material of claim 1, wherein $X_3$ is selected from the group consisting of an alkylene group, an oxyalkylene group, a —NH— group and a carboxyalkyleneoxy group.

17. The silver halide light-sensitive photographic material of claim 1, wherein said yellow dye-forming coupler is contained at an amount of $1\times10^{-3}$ mol to 1 mol per 1 mol of silver halide.

18. The silver halide light-sensitive photographic material of claim 17, wherein said yellow dye-forming coupler is contained at an amount of $1\times10^{-2}$ mol to $8\times10^{-1}$ mols per 1 mol of silver halide.

* * * * *